250-506.1 SR

OR 4,081,688

United Sta

Fries

[11] 4,081,688

[45] Mar. 28, 1978

[54] SHIELDED CONTAINER

[75] Inventor: Bernard A. Fries, Orinda, Calif.

[73] Assignee: Chevron Research Company, San Francisco, Calif.

[21] Appl. No.: 707,805

[22] Filed: Jul. 22, 1976

[51] Int. Cl.[2] ..... G21F 5/00

[52] U.S. Cl. ..... 250/506

[58] Field of Search ..... 250/506, 515

[56] References Cited

U.S. PATENT DOCUMENTS

| | | | |
|---|---|---|---|
| 3,531,644 | 9/1970 | Koster | 250/506 |
| 3,655,985 | 4/1972 | Brown et al. | 250/506 |
| 3,673,411 | 6/1972 | Glasser | 250/506 |
| 3,882,315 | 5/1975 | Soldan | 250/506 |

*Primary Examiner*—Davis L. Willis
*Attorney, Agent, or Firm*—R. L. Freeland, Jr.; H. D. Messner

[57] ABSTRACT

A shielded container for transportation of radioactive materials (RAM's) is disclosed in which leakage from the container is minimized due to constructional features including, inter alia, forming the container of a series of telescoping members having sliding fits between adjacent side walls and having at least two of the members including machine sealed lids and at least two of the elements including hand-tightenable caps. Result: A low probability of violation of Public Law 93-633 during transport of the RAM.

5 Claims, 1 Drawing Figure

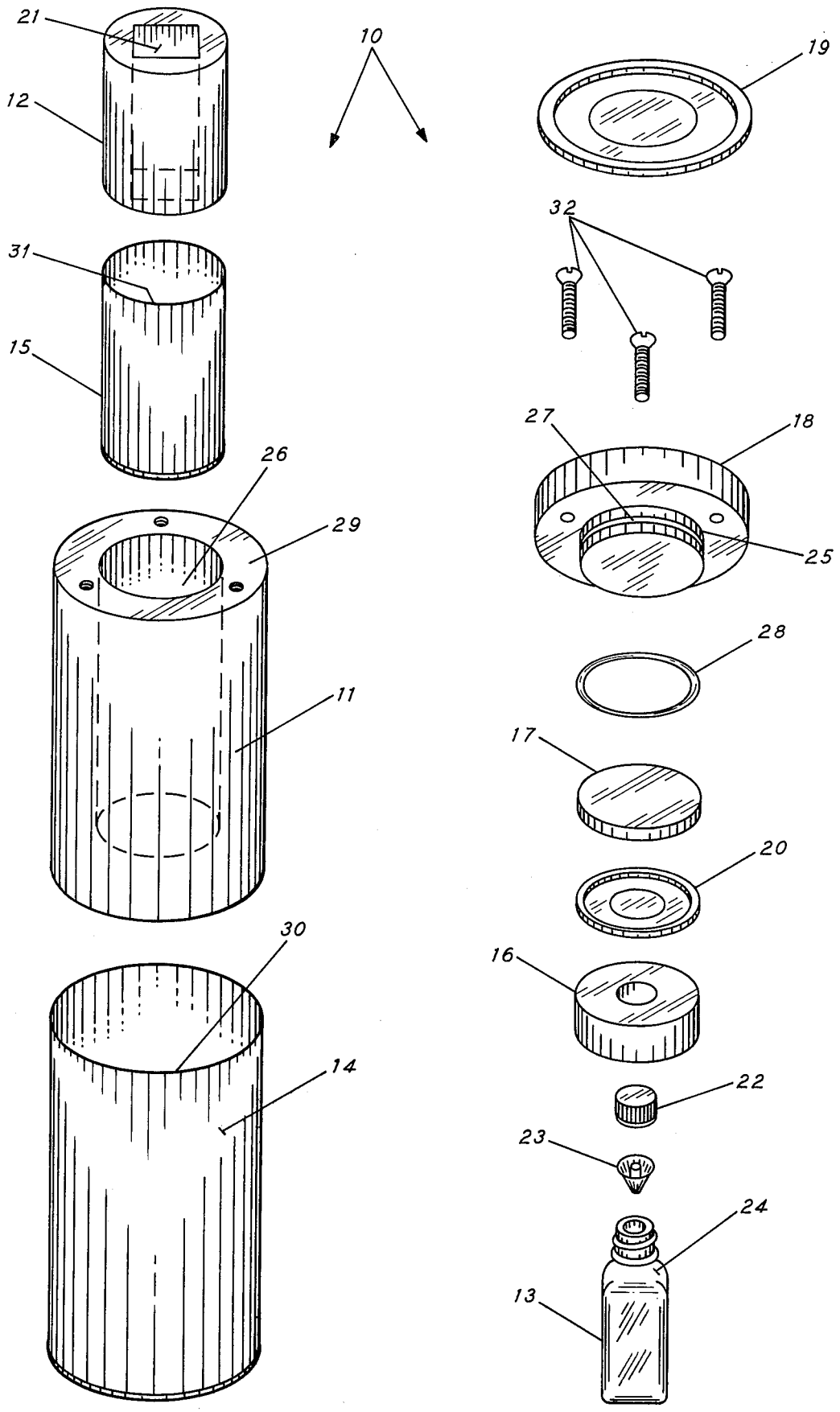
21
10
19
12
32
31
15
27
18
26
29
25
28
11
17
20
30
16
14
22
23
24
13

SHIELDED CONTAINER

BACKGROUND OF THE INVENTION

This invention relates to shielded containers for use in intrastate, interstate and international commerce, and especially to containers for shipping radioactive materials (RAM's) in full compliance with Public Law 93-633: "The Hazardous Materials Act", effective Jan. 1, 1975.

Public Law 93-633 specifies strict regulations in shipping hazardous materials in interstate and international commerce. While the manufacturer must comply with the specified regulations of this Law under threat of criminal prosecution, there can also be penalties attached to his customer who may want to reship a residue of the previously received hazardous material including any radioactive material (RAM) back to the manufacturer; e.g., the customer may want to return the RAM that is unused back to his manufacturer for disposal. Accordingly, not only must radioactive materials be housed in containers that prevent stray emission of radiation but also they must not leak during shipment in the first instance to the customer from the manufacturer, or for transshipment for other purposes including return to the manufacturer of the RAM.

OBJECT OF THE INVENTION

It is an object of the invention to provide a novel shielded container for radioactive materials in which a multiplicity of pressure-tight seals can be provided including a plurality of hand-actuated and machine-generated pressurized joints which effectively prevent leakage of the RAM during its shipment in interstate and international commerce, i.e., provide a RAM container in full compliance with Public Law 93-633.

SUMMARY OF THE INVENTION

In accordance with the present invention, a shielded container for radioactive materials, including a series of telescoping elements having sliding fits between adjacent sidewalls with at least two of the members having machine sealable lids and two of the elements having hand-tightenable caps, is provided. Result: There is a low probability that the container will violate Public Law 93-633.

DESCRIPTION OF THE DRAWING

The only drawing is an exploded perspective of the shielded RAM container of the present invention for housing radioactive materials in full compliance with Public Law 93-633.

DETAILED DESCRIPTION OF A PREFERRED EMBODIMENT OF THE INVENTION

Reference should now be had to the drawing in which shielded container 10 is shown in detail.

In general, the shielded container 10 includes a series of telescoping elements of differing sizes including lead shields 11 and 12 which can be slid into contact with and nested within one another. In that way, bottle 13 containing the RAM is safely prevent from either axial or radial travel (safeguarding against breakage) as well as protecting people against stray radioactive emissions from the RAM itself.

Note further that two of the elements comprising container 10 are conventional tin cans, i.e., cans 14 and 15, conventional for use in the canning industry. The larger of the cans, can 14, supports all elements within its interior: lead shields 11 and 12, bottle 13, smaller can 15, absorbent rings 16 and 17, as well as lead cap 18.

Both cans 14 and 15 are provided with lids 19 and 20. The lids are machine sealed to the respective upper end of the cans using an automatic can sealer such as provided by Wisconsin Aluminum Foundry Company, Inc., Manitowoc, Wisconsin, using their sealer "Senior Automatic Hand Sealer with Fly Wheel."

Within the smaller can 15 is the lead shield 12. It is preferably of a cylindrical configuration provided with a central repository 21 sized to accept the glass bottle 13 containing the RAM but open at both of its ends. Attached to the bottle 13 is its cap 22. Within the cap 22 is conical gasket 23. Adjacent the cap 22 and gasket 23, i.e., in the space between bottle shoulder 24 and cap 22, is absorbent ring 16. The material comprising the ring 16 is of sufficient absorptivity to absorb any leakage of the RAM from the bottle 13. Its volume also prevents axial movement of the bottle 13 within the lead shield 12.

Above the sealing lid 20 of the smaller can 15 is an additional absorbent ring, i.e., ring 17. In addition to its obvious absorbent qualities, the ring 17 also prevents axial movement of the elements within the sealed can 15 relative to lead cap 18.

Lead cap 18 is also a cylindrical configuration but reduced in size near one end to form a shoulder 25. The shoulder 25 is designed to snugly fit within central opening 26 of lead shield 11. The shoulder 25 is also provided with a groove 27 in which O-ring 28 resides. O-ring 28, when brought into contact with the interior of sidewall 29 of the lead shield 11, provides an additional pressurized joint, to prevent RAM leakage. Screws 32 are used to secure the cap 18 to the shield 11.

It should be observed that the thicknesses of the sidewalls 30, 31 of the cans 14 and 15, are not large. In fact, the cans 14 and 15 (with lids 19 and 20) can be omitted from the assembly (as when the customer is returning a portion of RAM to the manufacturer) without depreciating the ability of the container to withstand mechanical shocks. Note in such circumstance that leakage of the RAM from the container 10 is still prevented by caps 18 and 22 in association with absorbent rings 16 and 17. That is to say, a customer wishing to return the radioactive material within bottle 13 to the manufacturer even though cans 14 and 15 may have been opened, with their lids 19 and 20 removed, can still use the container 10 of the present invention for such purpose. Hand-tightenable bottle cap 22 and lead cap 18 with O-ring 27 provide sufficient integrity to the container on the return trip in full compliance with Public Law 93-633.

While a specific embodiment of this invention has been described, it should be understood that the invention is capable of incorporation within other designs, embodiments and modifications as defined by the following claims.

What is claimed is:

1. A shielded container for radioactive material comprising (a) a first cylindrical shield formed of radiation-resistive material, having a sidewall defining a central repository, a bottom wall, and a top cap, said top cap also being of radiation-resistive material and including an O-ring at a reduced end segment in contact with said side wall to form a pressurized joint for said central repository;

(b) a second cylindrical shield of radiation-resistive material having a side wall, and a central opening, said second shield being slideably positioned within said repository of said first shield;

(c) a bottle means of glass slideably located within said central opening of said second shield, said bottle means having a mouth, a bottle cap attached to said bottle mouth and a central cavity in which resides said radioactive material;

(d) a first machine-sealable, thin-walled can for nestedly receiving (b) and (c) therein;

(e) a second machine-sealable, thin-walled can for nestedly receiving (a), (b), (c) and (d) therein; and (f) said first and second cans each including machine-sealable top, bottom and side walls.

2. Said container of claim 1 in which both said central repository and said reduced end segment of (a) are of similar cylindrical shape and are of about the same diameter so that the latter can be slideably received in the former.

3. Said container of claim 2 with the addition of a first disk-like element of absorbent material sandwiched in said cylindrical repository of (a) between (i) said end segment of said top cap of (a) and (ii) said machine-sealable top wall of (d) to absorb any radioactive material leaking from (d) as well as to prevent axial travel of (d) relative to said central repository of (a).

4. Said container of claim 3 with the addition of a second disk-like element of absorbent material sandwiched both within said central repository of (a) and interior of (d), between said bottle cap of (c) and said machine-sealable top wall of (d) to absorb any radioactive material leaking from (c) as well as to prevent axial travel of (c) relative to (d).

5. Said container of claim 1 in which said top cap of (a) and said bottle cap of (c) are each hand-tightened whereby closure integrity is maintained within said shielded container.

* * * * *